US011728597B1

(12) United States Patent
Lee et al.

(10) Patent No.: US 11,728,597 B1
(45) Date of Patent: Aug. 15, 2023

(54) STRUCTURE OF UNIVERSAL SOCKET WITH POLARITY CORRECTION

(71) Applicants: Yueh-Ying Lee, New Taipei (TW); Yueh-Hui Lee, New Taipei (TW)

(72) Inventors: Yueh-Ying Lee, New Taipei (TW); Yueh-Hui Lee, New Taipei (TW)

(73) Assignee: YANG JI CO., LTD., New Taipei (TW)

( * ) Notice: Subject to any disclaimer, the term of this patent is extended or adjusted under 35 U.S.C. 154(b) by 38 days.

(21) Appl. No.: 17/588,126

(22) Filed: Jan. 28, 2022

(51) Int. Cl.

| | |
|---|---|
| ***H01R 24/28*** | (2011.01) |
| ***H01R 13/11*** | (2006.01) |
| ***H01R 25/00*** | (2006.01) |
| ***H01R 13/642*** | (2006.01) |
| *H01R 24/78* | (2011.01) |

(52) U.S. Cl.
CPC ..... *H01R 24/28* (2013.01); *H01R 13/11* (2013.01); *H01R 13/642* (2013.01); *H01R 25/006* (2013.01); *H01R 24/78* (2013.01)

(58) Field of Classification Search
CPC ..... H01R 24/28; H01R 24/78; H01R 13/11; H01R 13/10; H01R 13/05; H01R 13/04; H01R 13/02; H01R 13/005; H01R 13/642; H01R 13/64
USPC ..... 439/134
See application file for complete search history.

(56) References Cited

U.S. PATENT DOCUMENTS 5,702,259 A * 12/1997 Lee ..... H01R 13/4534 439/518
7,445,513 B1 * 11/2008 Lee ..... H01R 31/06 439/652
7,950,938 B1 * 5/2011 Teoh ..... H01R 31/06 439/171
8,142,208 B2 * 3/2012 Ruffner ..... H01R 13/4534 439/105
8,382,493 B2 * 2/2013 Ruffner ..... H01R 31/06 439/105
8,702,436 B2 * 4/2014 Lee ..... H01R 31/06 439/651
8,753,149 B2 * 6/2014 Lee ..... H01R 27/02 439/653
9,281,602 B2 * 3/2016 Ruffner ..... H01R 27/00
9,484,659 B1 * 11/2016 Lee ..... H01R 13/4534
10,992,093 B1 * 4/2021 Lee ..... H01R 31/06

* cited by examiner

*Primary Examiner* — Harshad C Patel
(74) *Attorney, Agent, or Firm* — Che-Yang Chen; Law Office of Michael Chen

(57) ABSTRACT

An improved structure of a universal socket with polarity correction comprising: a cover, a wedging body disposed under the cover, and a shell disposed under the wedging body. The cover is formed with first neutral, first live wire, second neutral, and second live wire electrode socket holes. The wedging body is formed with first neutral electrode, first live wire electrode, second neutral electrode, and second live wire electrode holding holes. Neutral and live wire electrode plate accommodating grooves, and an electrode plate assembly are disposed in the shell. The electrode plate assembly comprises a first neutral electrode plate and a second neutral electrode plate electrically connected to each other and disposed in the neutral electrode plate accommodating groove, and further comprises a first live wire electrode plate and a second live wire electrode plate electrically connected to each other and disposed in the live wire electrode plate accommodating groove.

10 Claims, 6 Drawing Sheets

STRUCTURE OF UNIVERSAL SOCKET WITH POLARITY CORRECTION

BACKGROUND OF THE INVENTION

Field of Invention

The invention is related to an improved structure of a universal socket, and more particularly to an improved structure of a universal socket with polarity correction capable of complying with polarities of multinational plugs to avoid electric leakage or interference.

Related Art

With the continuous development of society and economy, people travel abroad for business trips and other affairs more and more frequently. Therefore, travelers need to bring corresponding communication equipment or electrical appliances when traveling abroad, such as laptop, mobile phone, MP3 and other electronic products. Electronic products are power-consuming products, so it is necessary to prepare matching adapters to connect to electric power. However, because the communication interfaces of various countries in the world adopt different standards, the sockets in different regions will also have different configurations of holes. For this reason, universal sockets are available on the market, but this type of universal socket is mainly provided for plugging with plugs used in the local country. The main reason is that the neutral pin of the plug can be directly inserted into the neutral electrode plate, and the fire pin of the plug can be directly inserted into the fire electrode plate, but when the universal socket needs to match with plugs of other modes, the corresponding polarities cannot be connected correctly, which means that although plugs of different modes can still be inserted to conduct electricity, the plug is inserted into the fire electrode plate with the neutral pin, and inserted into the neutral electrode plate with the fire pin. Although the plug with this conduction mode can still be inserted and can conduct electric power, this conduction method will have a risk of electric leakage, and it may also cause some precision instruments to be interfered when being electrically conducted.

Therefore, the inventor of the invention and relevant manufacturers engaged in this industry are eager to research and make improvement to solve the above-mentioned problems and drawbacks in the prior art.

SUMMARY OF THE INVENTION

Therefore, in order to effectively solve the above-mentioned problems, a main object of the invention is to provide an improved structure of a universal socket with polarity correction capable of complying with polarities of multinational plugs to avoid electric leakage or interference.

In order to achieve the above-mentioned object, the invention provides an improved structure of a universal socket with polarity correction comprising: a cover, the cover being formed with a first neutral electrode socket hole, a first live wire electrode socket hole, a second neutral electrode socket hole, and a second live wire electrode socket hole; a wedging body, the wedging body being disposed under the cover, and the wedging body being formed with a first neutral electrode holding hole, a first live wire electrode holding hole, a second neutral electrode holding hole, and a second live wire electrode holding hole, and the wedging body being provided with a wedging assembly thereon, the wedging assembly comprising a first neutral electrode wedging member and a second neutral electrode wedging member respectively disposed in the first neutral electrode holding hole and the second neutral electrode holding hole, and the wedging assembly further comprising a first live wire electrode wedging member and a second live wire electrode wedging member respectively disposed in the first live wire electrode holding hole and the second live wire electrode holding hole; and a shell, the shell being disposed under the wedging body, a neutral electrode plate accommodating groove and a live wire electrode plate accommodating groove being formed in the shell, and an electrode plate assembly being disposed in the shell, the electrode plate assembly comprising a first neutral electrode plate and a second neutral electrode plate electrically connected to each other and disposed in the neutral electrode plate accommodating groove, and the electrode plate assembly further comprising a first live wire electrode plate and a second live wire electrode plate electrically connected to each other and disposed in the live wire electrode plate accommodating groove.

According to one embodiment of the improved structure of the universal socket with polarity correction of the invention, wherein the cover further comprises at least one first ground socket hole and a second ground socket hole.

According to one embodiment of the improved structure of the universal socket with polarity correction of the invention, wherein the wedging body further comprises at least one first ground top through hole and at least one second ground top through hole, the first ground top through hole communicates with the first ground socket hole, and the second ground top through hole communicates with the second ground socket hole.

According to one embodiment of the improved structure of the universal socket with polarity correction of the invention, wherein a first elastic member is disposed between the first neutral electrode wedging member and the second neutral electrode wedging member.

According to one embodiment of the improved structure of the universal socket with polarity correction of the invention, wherein a second elastic member is disposed between the first live wire electrode wedging member and the second live wire electrode wedging member.

According to one embodiment of the improved structure of the universal socket with polarity correction of the invention, wherein inside the shell is further formed with a ground electrode plate accommodating groove.

According to one embodiment of the improved structure of the universal socket with polarity correction of the invention, wherein the electrode plate assembly further comprises a first ground electrode plate and a second ground electrode plate electrically connected to each other and disposed in the ground electrode plate accommodating groove.

According to one embodiment of the improved structure of the universal socket with polarity correction of the invention, further comprising a bearing plate, the bearing plate being disposed between the wedging body and the shell, and the bearing plate being formed with a first neutral electrode through hole and a first live wire electrode through hole, the first neutral electrode through hole communicating with the first neutral electrode holding hole and the neutral electrode plate accommodating groove, the first live wire electrode through hole communicating with the first live wire electrode holding hole and the live wire electrode plate accommodating groove, and the bearing plate being further formed with a second neutral electrode through hole and a second live wire electrode through hole, the second neutral electrode through hole communicating with the second neutral electrode holding hole and the neutral electrode plate accommodating groove, and the second live wire electrode through hole communicating with the second live wire electrode holding hole and the live wire electrode plate accommodating groove.

According to one embodiment of the improved structure of the universal socket with polarity correction of the invention, wherein the bearing plate further comprises at least one first ground bottom through hole and a second ground bottom through hole, the first ground bottom through hole communicates with the first ground top through hole and the ground electrode plate accommodating groove, and the second ground bottom through hole communicates with the second ground top through hole and the ground electrode plate accommodating groove.

According to one embodiment of the improved structure of the universal socket with polarity correction of the invention, wherein the first neutral electrode plate and the second neutral electrode plate are electrically connected with a neutral electrode conducting plate, the first ground electrode plate and the second ground electrode plate are electrically connected with a ground electrode conducting plate, and the first live wire electrode plate and the second live wire electrode plate are electrically connected with a live wire electrode conducting plate, and a bottom of the shell is formed with a neutral electrode guide hole, a ground electrode guide hole and a live wire electrode guide hole respectively communicating with the neutral electrode plate accommodating groove, the ground electrode plate accommodating groove and the live wire electrode plate accommodating groove.

DETAILED DESCRIPTION OF THE INVENTION

The above objects of the invention, as well as its structural and functional features, will be described in accordance with the preferred embodiments of the accompanying drawings.

In the following, for the formation and technical content related to an improved structure of a universal socket with polarity correction in the invention, various applicable examples are exemplified and explained in detail with reference to the accompanying drawings; however, the invention is of course not limited to the enumerated embodiments, drawings, or detailed descriptions.

Furthermore, those who are familiar with this technology should also understand that the enumerated embodiments and accompanying drawings are only for reference and explanation, and are not used to limit the invention; other modifications or alterations that can be easily implemented based on the detailed descriptions of the invention are also deemed to be within the scope without departing from the spirit or intention thereof as defined by the appended claims and their legal equivalents.

And, the directional terms mentioned in the following embodiments, for example: "above", "under", "below", "left", "right", "front", "rear", etc., are only directions referring in the accompanying drawings. Therefore, the directional terms are used to illustrate rather than limit the invention. In addition, in the following embodiments, the same or similar elements will be labeled with the same or similar numerals.

Figure 1:
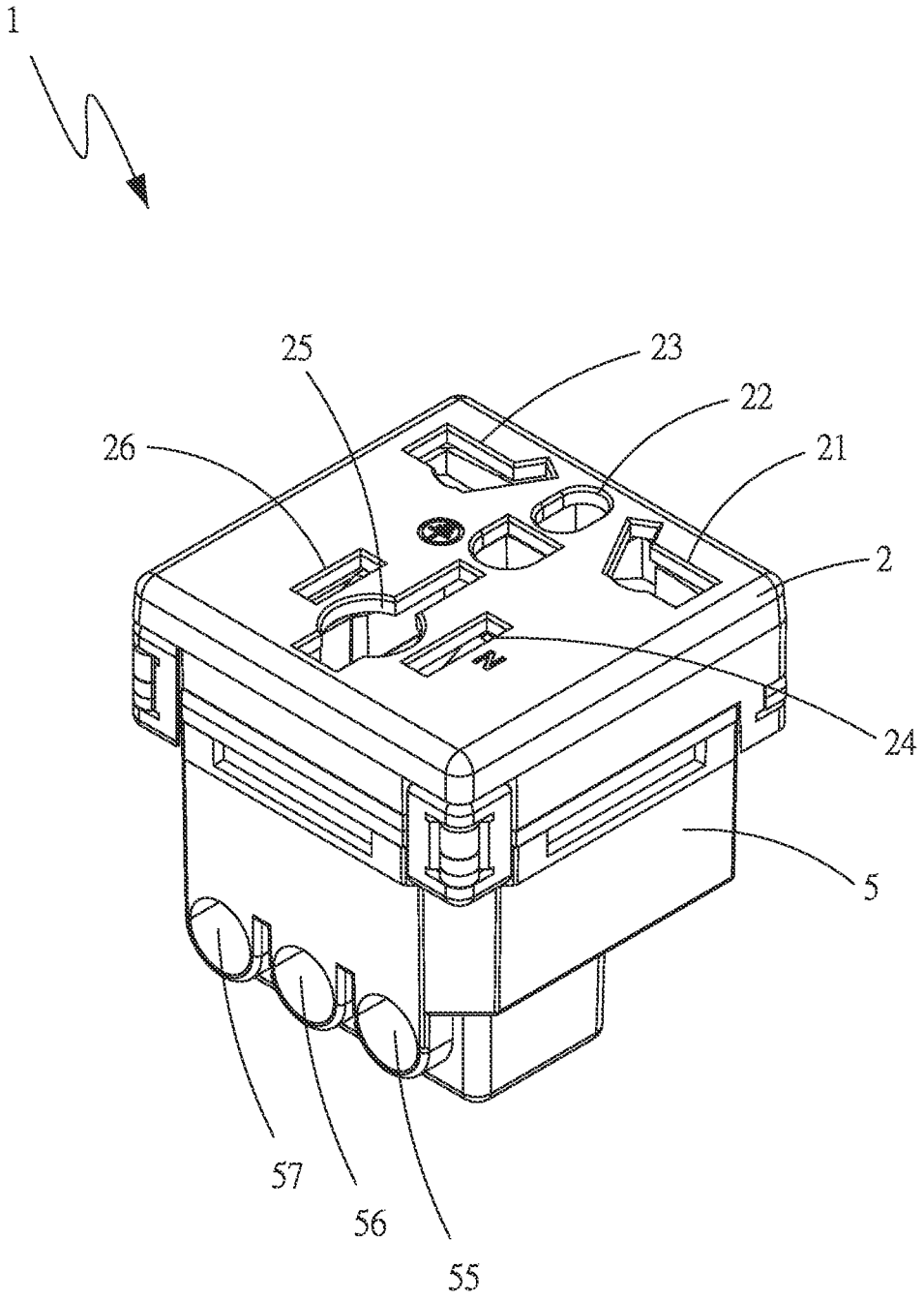
FIG. 1 is a perspective assembly view of an improved structure of a universal socket with polarity correction of the invention.
Figure 2:
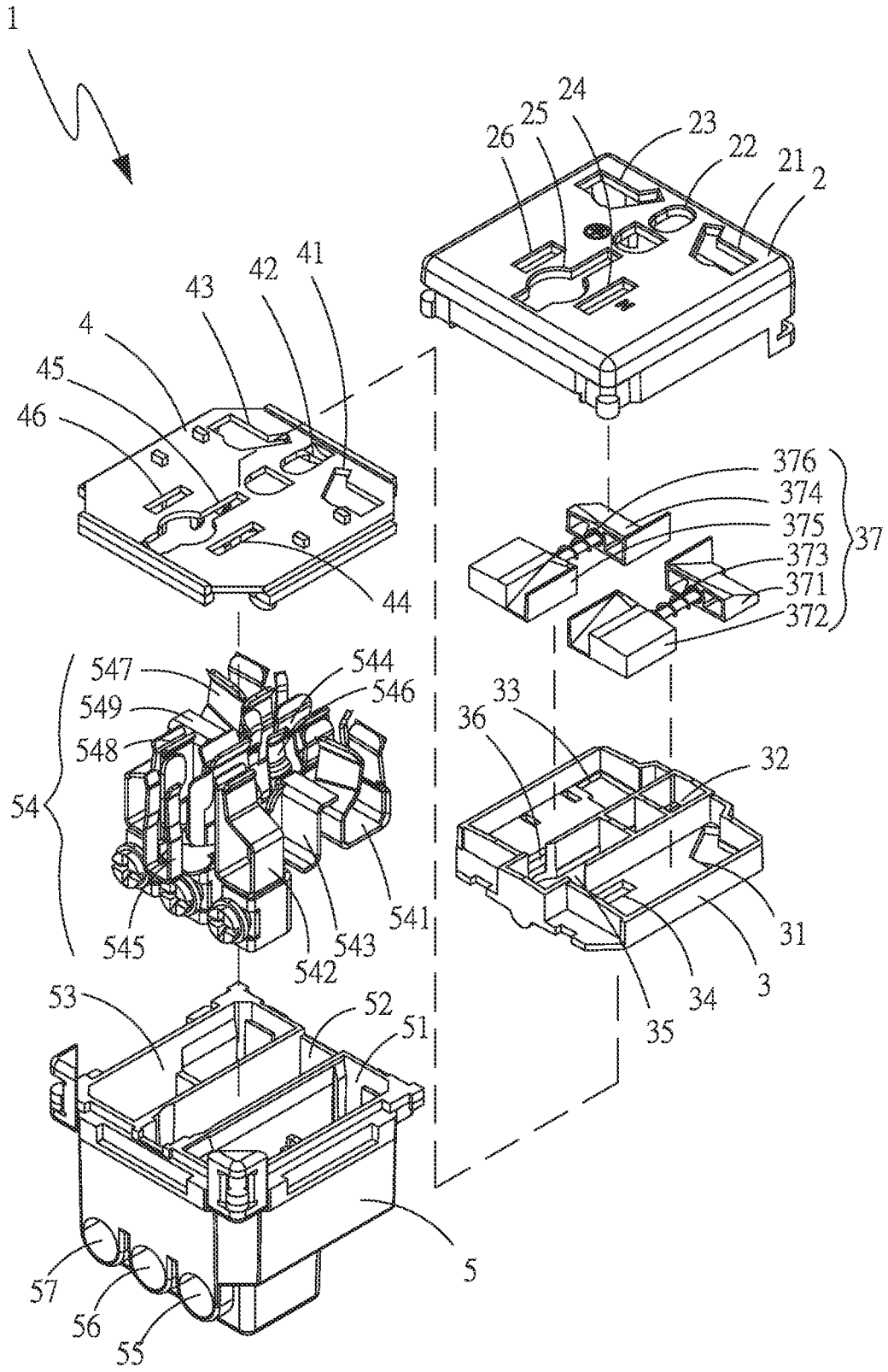
FIG. 2 is a perspective exploded view of the improved structure of the universal socket with polarity correction of the invention.

First of all, please refer to FIGS. 1 and 2 respectively for a perspective assembly view and a perspective exploded view of an improved structure of a universal socket with polarity correction of the invention. It can be clearly seen from the figures that an improved structure of a universal socket 1 comprises: a cover 2, a wedging body 3, a bearing plate 4, and a shell 5.

Wherein one side of the cover 2 is penetrated with a first neutral electrode socket hole 21, at least one first ground socket hole 22, and a first live wire electrode socket hole 23, and another side of the cover 2 is penetrated with a second neutral electrode socket hole 24, a second ground socket hole 25, and a second live wire electrode socket hole 26, and a length of the second neutral electrode socket hole 24 is greater than that of the second live wire electrode socket hole 26.

Wherein the wedging body 3 is disposed under the cover 2, one side of the wedging body 3 is penetrated with a first neutral electrode holding hole 31, at least one first ground top through hole 32, and a first live wire electrode holding hole 33; the first neutral electrode holding hole 31, the first ground top through hole 32, and the first live wire electrode holding hole 33 are respectively disposed under the first neutral electrode socket hole 21, the first ground socket hole 22, and the first live wire electrode socket hole 23 correspondingly; and the first ground top through hole 32 communicates with the first ground socket hole 22; and another side of the wedging body 3 is penetrated with a second neutral electrode holding hole 34, at least one second ground top through hole 35, and a second live wire electrode holding hole 36; the second neutral electrode holding hole 34, the second ground top through hole 35, and the second live wire electrode holding hole 36 are respectively disposed under the second neutral electrode socket hole 24, the second ground socket hole 25, and the second live wire electrode socket hole 26 correspondingly; and the second ground top through hole 35 communicates with the second ground socket hole 25; the wedging body 3 is provided with a wedging assembly 37 thereon; the wedging assembly 37 comprises a first neutral electrode wedging member 371, a second neutral electrode wedging member 372, a first live wire electrode wedging member 374, and a second live wire electrode wedging member 375; the first neutral electrode wedging member 371 and the second neutral electrode wedging member 372 are respectively disposed in the first neutral electrode holding hole 31 and the second neutral electrode holding hole 34; a first elastic member 373 is disposed between the first neutral electrode wedging member 371 and the second neutral electrode wedging member 372; the first live wire electrode wedging member 374 and the second live wire electrode wedging member 375 are respectively disposed in the first live wire electrode holding hole 33 and the second live wire electrode holding hole 36; and a second elastic member 376 is disposed between the first live wire electrode wedging member 374 and the second live wire electrode wedging member 375.

Wherein the bearing plate 4 is disposed between the wedging body 3 and the shell 5, one side of the bearing plate 4 is formed with a first neutral electrode through hole 41, at least one first ground bottom through hole 42, and a first live wire electrode through hole 43; the first neutral electrode through hole 41 communicates with the first neutral electrode holding hole 31, the first ground bottom through hole 42 communicates with the first ground top through hole 32, and the first live wire electrode through hole 43 communicates with first live wire electrode holding hole 33; and another side of the bearing plate 4 is formed with a second neutral electrode through hole 44, a second ground bottom through hole 45, and a second live wire electrode through hole 46; the second neutral electrode through hole 44 communicates with the second neutral electrode holding hole 34, the second ground bottom through hole 45 communicates with the second ground top through hole 35, and the second live wire electrode through hole 46 communicates with the second live wire electrode holding hole 36.

Wherein the shell 5 is disposed under the wedging body 3, inside the shell 5 is formed with a neutral electrode plate accommodating groove 51, a ground electrode plate accommodating groove 52, and a live wire electrode plate accommodating groove 53; the neutral electrode plate accommodating groove 51 communicates with the first neutral electrode through hole 41 and the second neutral electrode through hole 44, the ground electrode plate accommodating groove 52 communicates with the first ground bottom through hole 42 and the second ground bottom through hole 45, and the live wire electrode plate accommodating groove 53 communicates with the first live wire electrode through hole 43 and the second live wire electrode through hole 46; an electrode plate assembly 54 is disposed in the shell 5, the electrode plate assembly 54 comprises a first neutral electrode plate 541 and a second neutral electrode plate 542 electrically connected to each other and disposed in the neutral electrode plate accommodating groove 51, and the first neutral electrode plate 541 and the second neutral electrode plate 542 are electrically connected with a neutral electrode conducting plate 543; the electrode plate assembly 54 further comprises a first ground electrode plate 544 and a second ground electrode plate 545 electrically connected to each other and disposed in the ground electrode plate accommodating groove 52, and the first ground electrode plate 544 and the second ground electrode plate 545 are electrically connected with a ground electrode conducting plate 546; the electrode plate assembly 54 further comprises a first live wire electrode plate 547 and a second live wire electrode plate 548 electrically connected to each other and disposed in the live wire electrode plate accommodating groove 53, and the first live wire electrode plate 547 and the second live wire electrode plate 548 are electrically connected with a live wire electrode conducting plate 549; and a bottom of the shell 5 is formed with a neutral electrode guide hole 55, a ground electrode guide hole 56 and a live wire electrode guide hole 57 respectively communicating with the neutral electrode plate accommodating groove 51, the ground electrode plate accommodating groove 52 and the live wire electrode plate accommodating groove 53.

Figure 3:
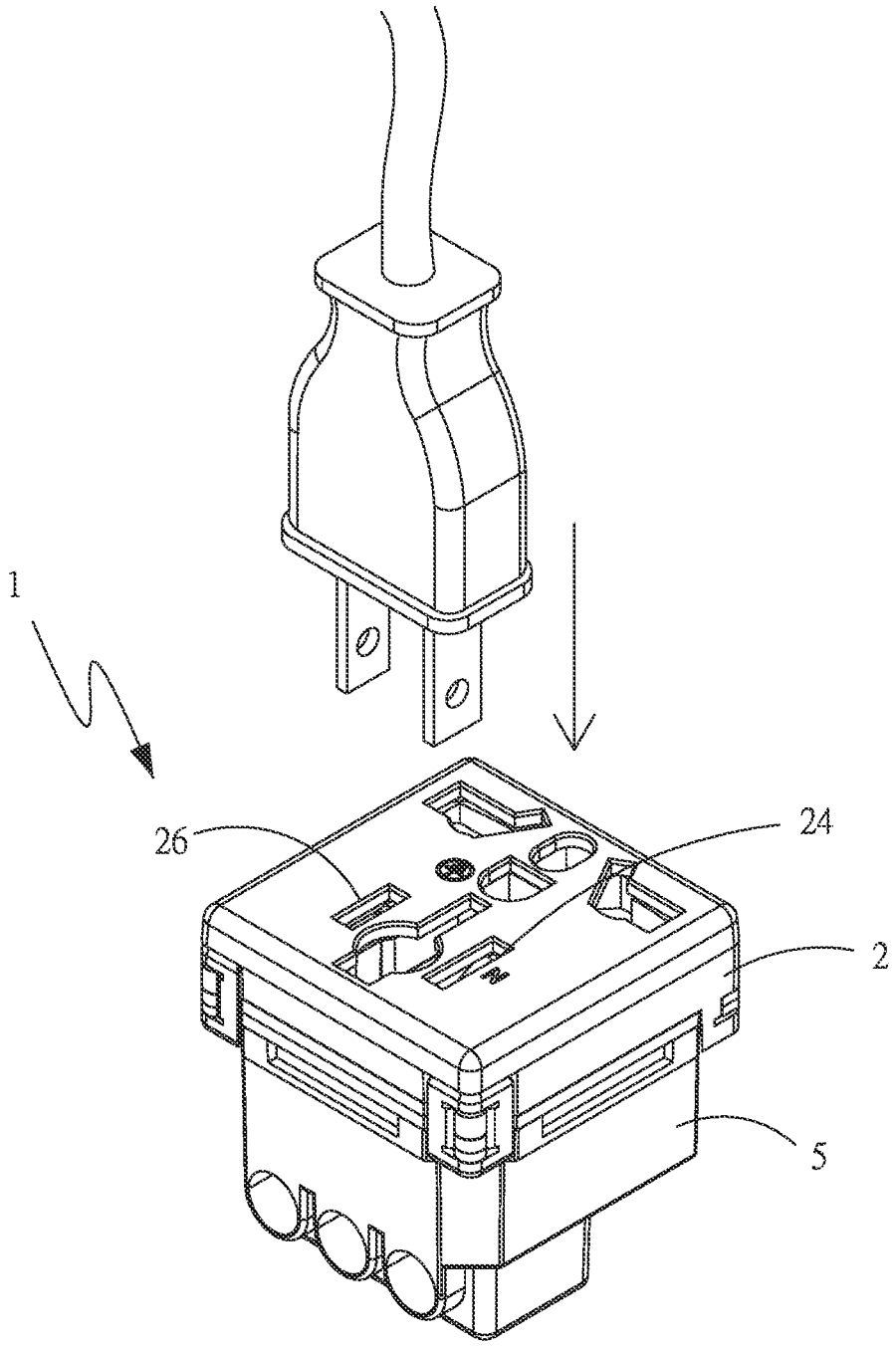
FIG. 3 is a first perspective view of implementation of the improved structure of the universal socket with polarity correction of the invention.
Figure 4:
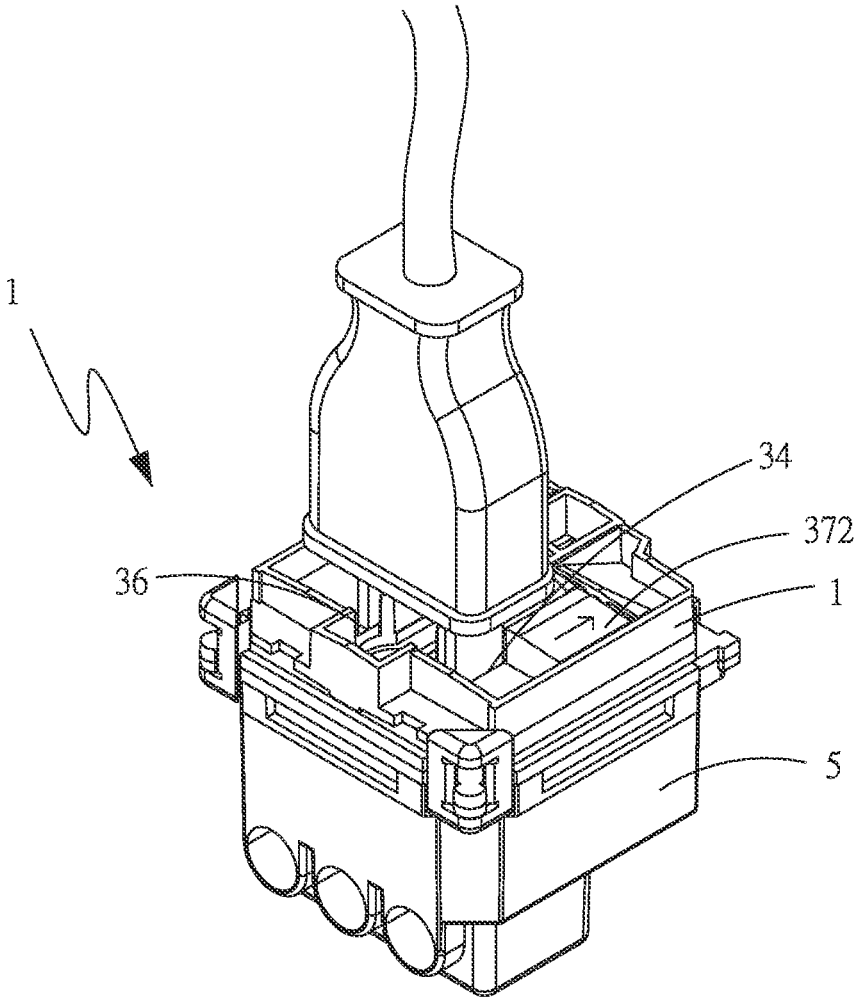
FIG. 4 is a second perspective view of implementation of the improved structure of the universal socket with polarity correction of the invention.
Figure 5:
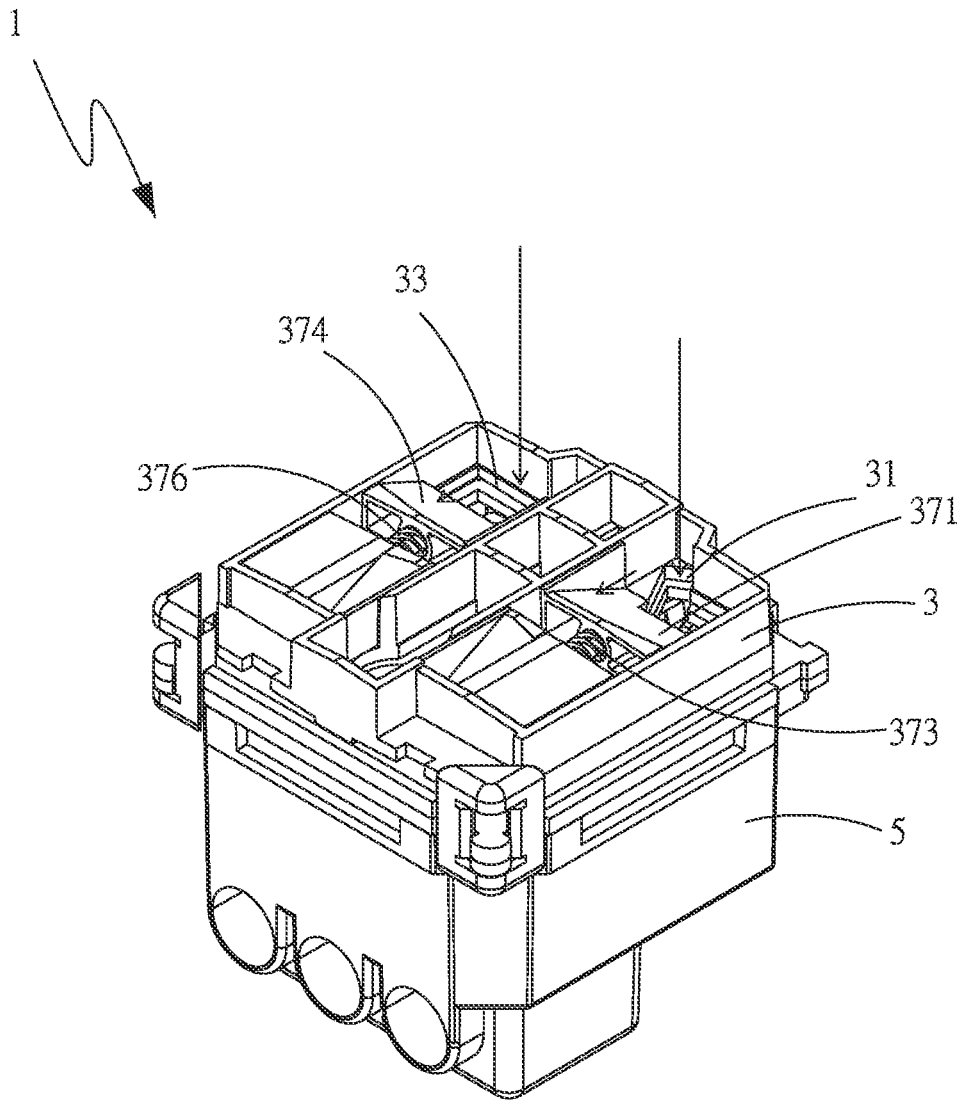
FIG. 5 is a third perspective view of implementation of the improved structure of the universal socket with polarity correction of the invention.

Please refer to the aforementioned drawings and FIGS. 3, 4 and 5 respectively for a first perspective view of implementation, a second perspective view of implementation and a third perspective view of implementation of the improved structure of the universal socket 1 with polarity correction of the invention. Wherein the improved structure of the universal socket 1 can be used for wall plugging, a neutral electrode wire in the wall enters the neutral electrode plate accommodating groove 51 through the neutral electrode guide hole 55 and electrically connects to the second neutral electrode plate 542 and the first neutral electrode plate 541, a ground wire in the wall enters the ground electrode plate accommodating groove 52 through the ground electrode guide hole 56 and electrically connects to the second ground electrode plate 545 and the first ground electrode plate 544, and a live electrode wire in the wall enters the live wire electrode plate accommodating groove 53 through the live wire electrode guide hole 57 and electrically connects to the second live wire electrode plate 548 and the first live wire electrode plate 547, thereby the improved structure of the universal socket 1 can be provided for inserting plugs by users.

Wherein all the live wire pins (L) of the plugs in Taiwan, Japan, the United States and some countries are disposed on the left side, so when the plugs in Taiwan, Japan, the United States and some countries need to be plugged into the improved structure of the universal socket 1, the neutral pin (N) can be directly inserted into the second neutral electrode socket hole 24, and the live wire pin (L) can be directly inserted into the second live wire electrode socket hole 26. In addition to the N indicated on the cover 2, a structural feature of the length of the second neutral electrode socket hole 24 being greater than that of the second live wire electrode socket hole 26 is provided to prevent users from inserting a plug with wrong polarities in the socket holes. Thereby, the improved structure of the universal socket 1 is applicable for using with plugs with the live wire pin (L) on the left side to avoid the occurrence of electric leakage or interference, and therefore the improved structure of the universal socket 1 is capable of achieving an efficacy of complying with polarities of multinational plugs.

Wherein after the neutral pin (N) is directly inserted into the second neutral electrode socket hole 24, and the live wire pin (L) is directly inserted into the second live wire electrode socket hole 26, the neutral pin (N) pushes the second neutral electrode wedging member 372 to move in a direction toward the first neutral electrode wedging member 371 until the neutral pin (N) passes through the second neutral electrode holding hole 34 and the second neutral electrode through hole 44 and electrically connects to the second neutral electrode plate 542, and then the second neutral electrode wedging member 372 is elastically pressed by the first elastic member 373 to clamp the neutral pin (N).

Wherein the live wire pin (L) pushes the second live wire electrode wedging member 375 to move in a direction toward the first live wire electrode wedging member 374 until the live wire pin (L) passes through the second live wire electrode holding hole 36 and the second live wire electrode through hole 46 and electrically connects to the second live wire electrode plate 548, and then the second live wire electrode wedging member 375 is elastically pressed by the second elastic member 376 to clamp the live wire pin (L). Thereby, in addition to the improved structure of the universal socket 1 being applicable for using with plugs with the live wire pin (L) on the left side to avoid the occurrence of electric leakage or interference, the improved structure of the universal socket 1 is also capable of clamping the live wire pin (L) and the neutral pin (N) by the wedging assembly 37 to avoid fire accidents caused by loosening of the pins of a plug.

Wherein all the live wire pins (L) of the plugs in the United Kingdom, India, Australia and some countries are disposed on the right side, so when the plugs in the United Kingdom, India, Australia and some countries need to be plugged into the improved structure of the universal socket 1, the neutral pin (N) can be directly inserted into the first neutral electrode socket hole 21, and the live wire pin (L) can be directly inserted into the first live wire electrode socket hole 23. In addition to the N indicated on the cover 2, a structural feature of a disposing position of the first ground socket hole 22 is provided to prevent users from inserting a plug with wrong polarities in the socket holes. Thereby, the improved structure of the universal socket 1 is applicable for using with plugs with the live wire pin (L) on the right side to avoid the occurrence of electric leakage or interference.

Wherein after the neutral pin (N) is directly inserted into the first neutral electrode socket hole 21, and the live wire pin (L) is directly inserted into the first live wire electrode socket hole 23, the neutral pin (N) pushes the first neutral electrode wedging member 371 to move in a direction toward the second neutral electrode wedging member 372 until the neutral pin (N) passes through the first neutral electrode holding hole 31 and the first neutral electrode through hole 41 and electrically connects to the first neutral electrode plate 541, and then the first neutral electrode wedging member 371 is elastically pressed by the first elastic member 373 to clamp the neutral pin (N).

Wherein the live wire pin (L) pushes the first live wire electrode wedging member 374 to move in a direction toward the second live wire electrode wedging member 375 until the live wire pin (L) passes through the first live wire electrode holding hole 33 and the first live wire electrode through hole 43 and electrically connects to the first live wire electrode plate 547, and then the first live wire electrode wedging member 374 is elastically pressed by the second elastic member 376 to clamp the live wire pin (L). Thereby, in addition to the improved structure of the universal socket 1 being applicable for using with plugs with the live wire pin (L) on the right side to avoid the occurrence of electric leakage or interference, the improved structure of the universal socket 1 is also capable of clamping the live wire pin (L) and the neutral pin (N) by the wedging assembly 37 to avoid fire accidents caused by loosening of the pins of a plug.

Figure 6:
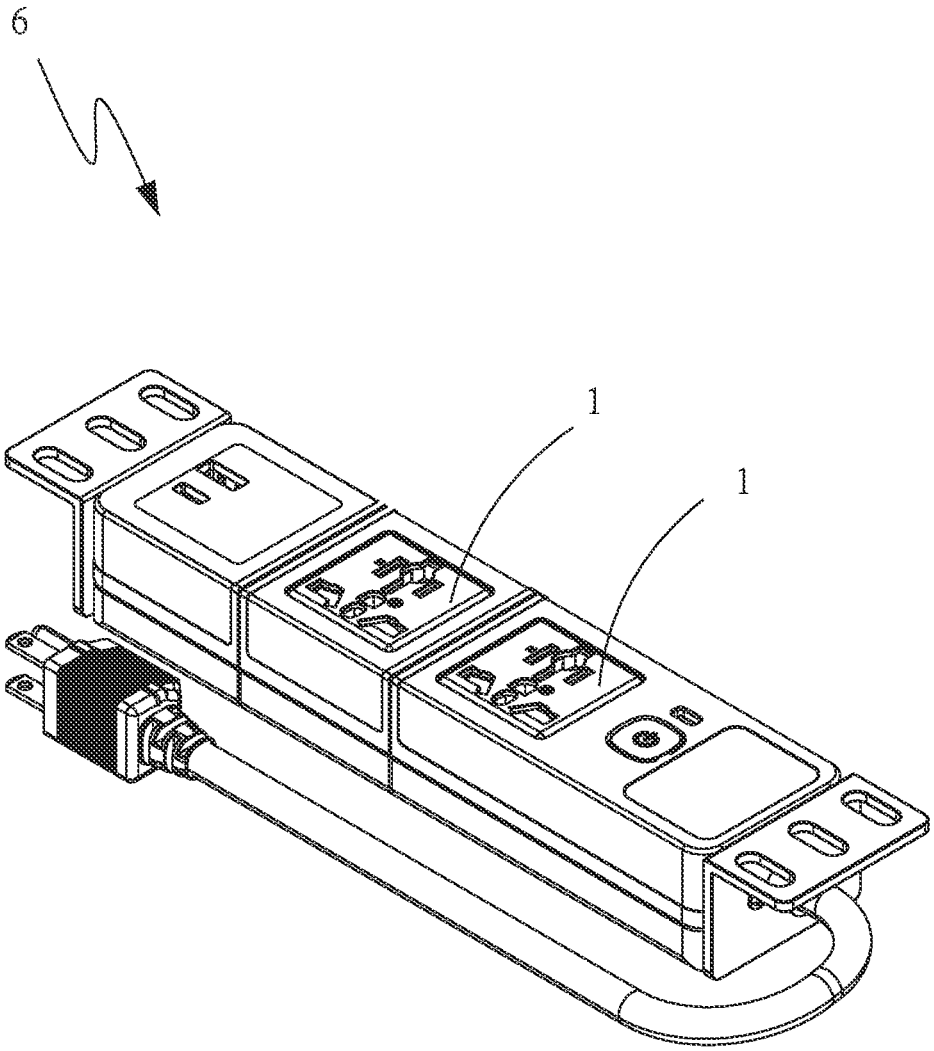
FIG. 6 is a perspective view of implementation of modularization of the improved structure of the universal socket with polarity correction of the invention.

Please refer to the aforementioned drawings and FIG. 6 for a perspective view of implementation of modularization of the improved structure of the universal socket 1 with polarity correction of the invention. In addition to the improved structure of the universal socket 1 being capable of installing in a wall for wall plugging, the improved structure of the universal socket 1 can also be assembled as an extension cord device 6 with multiple sets of the improved structure of the universal socket 1, so that the extension cord device 6 is capable of complying with polarities of multinational plugs to avoid the occurrence of electric leakage or interference.

It is to be understood that the above description is only preferred embodiments of the invention and is not used to limit the invention, and changes in accordance with the concepts of the invention may be made without departing from the spirit of the invention, for example, the equivalent effects produced by various transformations, variations, modifications and applications made to the configurations or arrangements shall still fall within the scope covered by the appended claims of the invention.

What is claimed is:

1. An improved structure of a universal socket with polarity correction comprising:

a cover, the cover being formed with a first neutral electrode socket hole, a first live wire electrode socket hole, a second neutral electrode socket hole, and a second live wire electrode socket hole;

a wedging body, the wedging body being disposed under the cover, and the wedging body being formed with a first neutral electrode holding hole, a first live wire electrode holding hole, a second neutral electrode holding hole, and a second live wire electrode holding hole, and the wedging body being provided with a wedging assembly thereon, the wedging assembly comprising a first neutral electrode wedging member and a second neutral electrode wedging member respectively disposed in the first neutral electrode holding hole and the second neutral electrode holding hole, and the wedging assembly further comprising a first live wire electrode wedging member and a second live wire electrode wedging member respectively disposed in the first live wire electrode holding hole and the second live wire electrode holding hole; and a shell, the shell being disposed under the wedging body, a neutral electrode plate accommodating groove and a live wire electrode plate accommodating groove being formed in the shell, and an electrode plate assembly being disposed in the shell, the electrode plate assembly comprising a first neutral electrode plate and a second neutral electrode plate electrically connected to each other and disposed in the neutral electrode plate accommodating groove, and the electrode plate assembly further comprising a first live wire electrode plate and a second live wire electrode plate electrically connected to each other and disposed in the live wire electrode plate accommodating groove.

2. The improved structure of the universal socket with polarity correction as claimed in claim 1, wherein the cover further comprises at least one first ground socket hole and a second ground socket hole.

3. The improved structure of the universal socket with polarity correction as claimed in claim 2, wherein the wedging body further comprises at least one first ground top through hole and at least one second ground top through hole, the first ground top through hole communicates with the first ground socket hole, and the second ground top through hole communicates with the second ground socket hole.

4. The improved structure of the universal socket with polarity correction as claimed in claim 3, wherein inside the shell is further formed with a ground electrode plate accommodating groove.

5. The improved structure of the universal socket with polarity correction as claimed in claim 4, wherein the electrode plate assembly further comprises a first ground electrode plate and a second ground electrode plate electrically connected to each other and disposed in the ground electrode plate accommodating groove.

6. The improved structure of the universal socket with polarity correction as claimed in claim 4, further comprising a bearing plate, the bearing plate being disposed between the wedging body and the shell, and the bearing plate being formed with a first neutral electrode through hole and a first live wire electrode through hole, the first neutral electrode through hole communicating with the first neutral electrode holding hole and the neutral electrode plate accommodating groove, the first live wire electrode through hole communicating with the first live wire electrode holding hole and the live wire electrode plate accommodating groove, and the bearing plate being further formed with a second neutral electrode through hole and a second live wire electrode through hole, the second neutral electrode through hole communicating with the second neutral electrode holding hole and the neutral electrode plate accommodating groove, and the second live wire electrode through hole communicating with the second live wire electrode holding hole and the live wire electrode plate accommodating groove.

7. The improved structure of the universal socket with polarity correction as claimed in claim 6, wherein the bearing plate further comprises at least one first ground bottom through hole and a second ground bottom through hole, the first ground bottom through hole communicates with the first ground top through hole and the ground electrode plate accommodating groove, and the second ground bottom through hole communicates with the second ground top through hole and the ground electrode plate accommodating groove.

8. The improved structure of the universal socket with polarity correction as claimed in claim 5, wherein the first neutral electrode plate and the second neutral electrode plate are electrically connected with a neutral electrode conducting plate, the first ground electrode plate and the second ground electrode plate are electrically connected with a ground electrode conducting plate, and the first live wire electrode plate and the second live wire electrode plate are electrically connected with a live wire electrode conducting plate, and a bottom of the shell is formed with a neutral electrode guide hole, a ground electrode guide hole and a live wire electrode guide hole respectively communicating with the neutral electrode plate accommodating groove, the ground electrode plate accommodating groove and the live wire electrode plate accommodating groove.

9. The improved structure of the universal socket with polarity correction as claimed in claim 1, wherein a first elastic member is disposed between the first neutral electrode wedging member and the second neutral electrode wedging member.

10. The improved structure of the universal socket with polarity correction as claimed in claim 9, wherein a second elastic member is disposed between the first live wire electrode wedging member and the second live wire electrode wedging member.

* * * * *